United States Patent [19]

Larsen et al.

[11] 4,427,165

[45] Jan. 24, 1984

[54] SEWING MACHINE THREAD GUIDE WITH PROTECTIVE GUARD

[75] Inventors: Robert H. Larsen, Middletown; Harold R. Piszczek, Randolph, both of N.J.

[73] Assignee: The Singer Company, Stamford, Conn.

[21] Appl. No.: 491,153

[22] Filed: May 4, 1983

[51] Int. Cl.[3] ..... B65H 57/04; B63B 21/34

[52] U.S. Cl. ..... 242/157; 112/302; 112/270

[58] Field of Search ..... 112/302, 270; 242/157 R, 157 B; 57/106

[56] References Cited

U.S. PATENT DOCUMENTS

| | | | |
|---|---|---|---|
| 1,956,338 | 4/1934 | Bartling | 242/157 |
| 3,278,137 | 10/1966 | Hartley | 112/270 X |
| 3,552,678 | 1/1971 | Du Ross | 112/270 X |
| 3,713,605 | 1/1973 | Vahle et al. | 242/157 |

*Primary Examiner*—H. Hampton Hunter

*Attorney, Agent, or Firm*—William V. Ebs; Edward L. Bell; Robert E. Smith

[57] ABSTRACT

A plastic guide for thread extending from a supply spool to the sewing instrumentalities of a sewing machine is provided with a metal wear bar to engage thread exiting from an opening in the guide and prevent the thread from cutting a groove in the plastic material of the guide at the edge of the opening.

9 Claims, 7 Drawing Figures

SEWING MACHINE THREAD GUIDE WITH PROTECTIVE GUARD

DESCRIPTION

BACKGROUND OF THE INVENTION

1. Field of the Invention

The invention is directed to a sewing machine thread guide and to means for preventing damage thereto.

2. Description of the Prior Art

It is well known to alter the direction of the thread path on a sewing machine with a plastic thread guide having an opening through which the thread passes on the way to sewing instrumentalities on the machine. A type of thread guide in common use may be seen, for example, in U.S. Pat. No. 3,713,605 of Erwin Vahle et al for "Quick Threading Thread Guide for Sewing Machines", issued Jan. 30, 1973.

A difficulty which is encountered with plastic guides of the kind indicated is that the thread tends to wear grooves in the soft plastic material at the exit end of the through opening in the guide and, as the plastic surface becomes rough and uneven, damage to the thread ensues.

It is a prime object of the present invention to prevent abrasive damage to a plastic thread guide by thread passing through an opening in the guard on the way to the sewing instrumentalities of a sewing machine.

It is another object of the invention to provide a plastic thread guide with a metal wear bar to engage thread passing through the guide, and to thereby prevent damage by the thread to the plastic material of the guide.

Other objects and advantages of the invention will become apparent during a reading of the specification taken in connection with the accompanying drawings.

SUMMARY OF THE INVENTION

In accordance with the invention, a plastic thread guide for a sewing machine having an opening for thread to pass therethrough on the way to sewing instrumentalities is provided with a metal wear bar to engage thread on the exit side of the guide. The guide supports thread extending from the exit side of the guide in a different direction from the entering thread and so prevents the thread from cutting into the plastic material of the guide at the edge of the through opening on the thread exiting side of the guide. On a guide having a through opening for each of two threads used in twin needle sewing, the wear bar engages both threads and prevents abrasive damage to the guide at each opening.

DESCRIPTION OF THE PREFERRED EMBODIMENT

Figure 1:
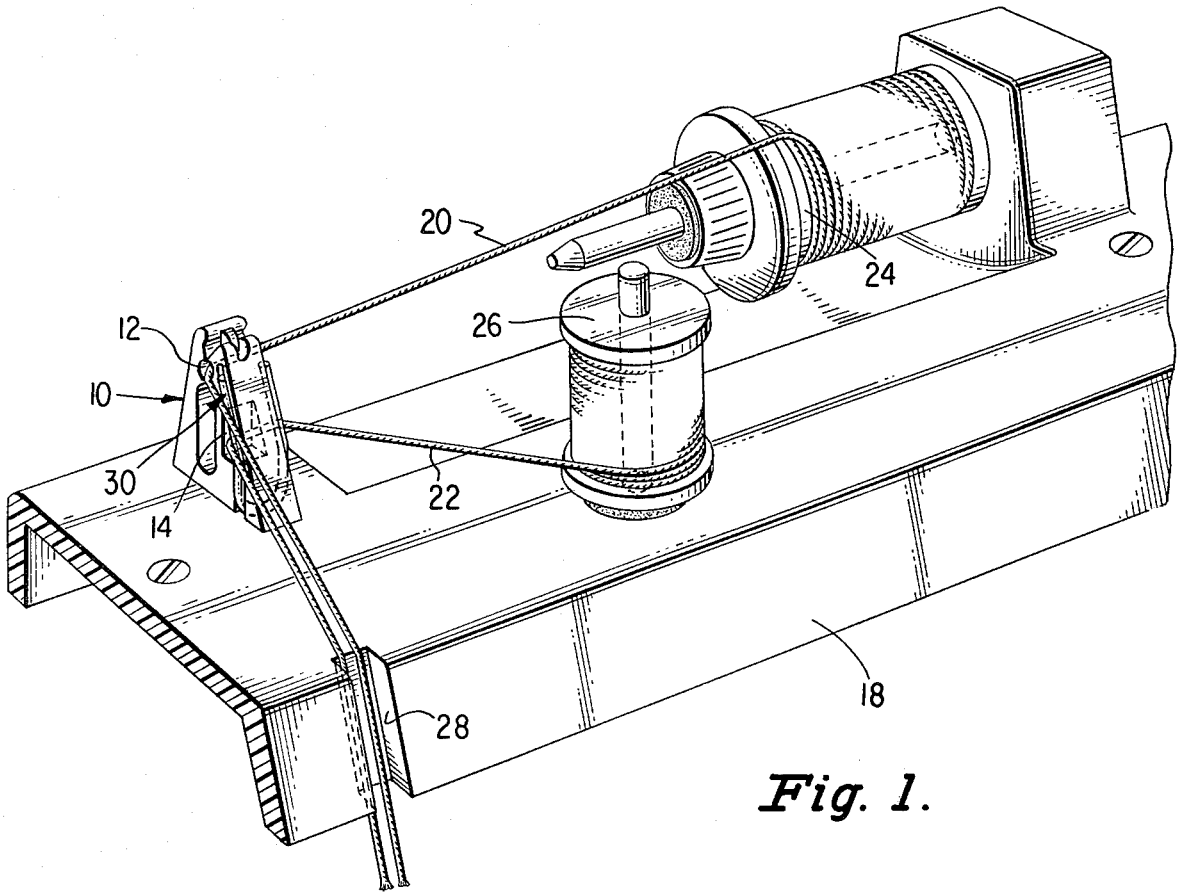
FIG. 1 is a fragmentary perspective view showing a thread guide according to the invention on a sewing machine top cover.
Figure 2:
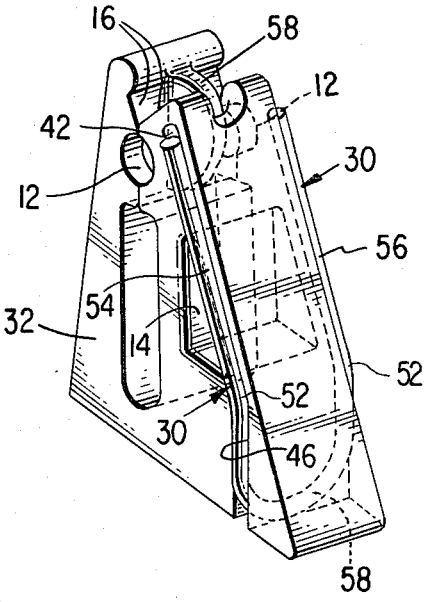
FIG. 2 is a perspective view of the thread guide.
Figure 3:
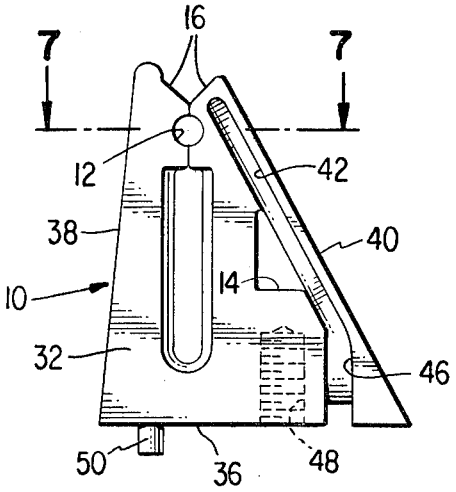
FIG. 3 is a left side view of the thread guide without the wear bar thereon.
Figure 4:
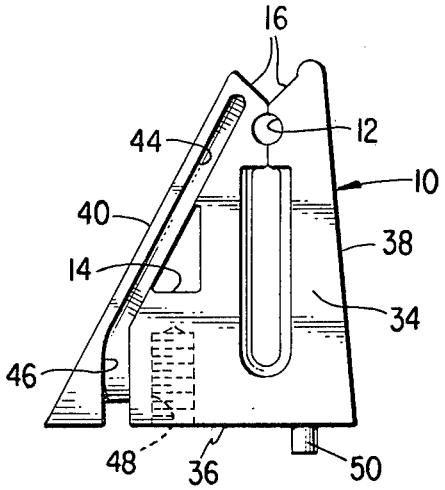
FIG. 4 is a right side view of the thread guide without the wear bar.
Figure 5:
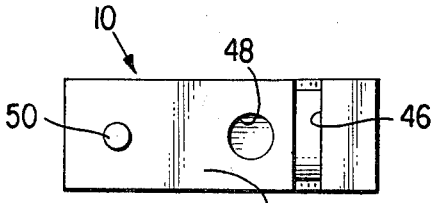
FIG. 5 is a bottom view of the thread guide without the wear bar.
Figure 7:
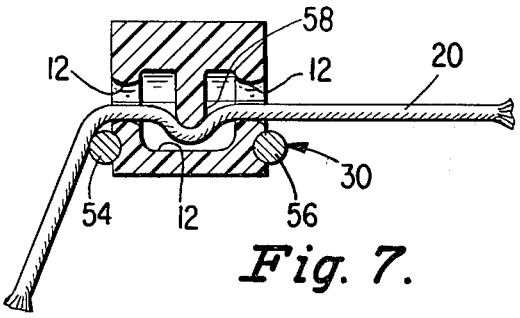
FIG. 7 is a sectional view taken on the plane of the line 7—7 of FIG. 3.
Figure 6:
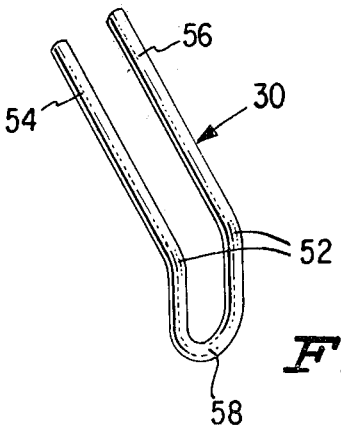
FIG. 6 is a perspective view of the wear bar.

Referring to the drawings, reference character 10 designates a plastic thread guide for a sewing machine. Guide 10 is generally of the type disclosed in U.S. Pat. No. 3,713,605 of Erwin Vahle et al for "Quick Threading Thread Guide for Sewing Machines" issued Jan. 30, 1973, but can accommodate two threads rather than a single thread to which the guide of the patent is limited. As shown, thread guide 10 includes a thread guiding eyelet 12 near the top end thereof, and another through opening 14 for a second thread. Eyelet 12 is used when sewing with a single thread, and opening 14 is used to guide a second thread during twin needle sewing operations. Thread is introduced into eyelet 12 by way of a V-shaped notch 16 at the top of the guide as in the manner indicated in U.S. Pat. No. 3,713,605. When a second thread is used, it is directly threaded through opening 14.

Guide 10 may be seen in use in FIG. 1 on the top cover 18 of a sewing machine with threads 20 and 22 from two thread supplying spools 24 and 26, respectively, for twin needle sewing passing through the guide, and extending therefrom to a slot 28 as on the way to thread tensioning and takeup mechanism (not shown). The thread path between the spools and slot 28 is sharply altered by the thread guide and, because of such alteration in the direction of the thread path, grooves would be worn in the plastic material of the guide around eyelet 12 and opening 14 on the thread exiting side of the guide except for a wear bar 30 mounted on the guide in accordance with the invention.

The plastic guide 10 has triangularly shaped opposite sides 32 and 34, and has rectangularly shaped edges. The rectangularly shaped edges include bottom and upright edges 36 and 38, respectively, which are mutually perpendicular, and an inclined edge 40. Each of the opposite sides 32 and 34 of the guide is grooved in like fashion to receive and hold wear bar 30. As shown, sides 32 and 34 are provided with grooves 42 and 44, respectively, extending parallel and in close proximity to inclined edge 40. The guide is also provided with a groove 46 extending about bottom edge 36 and into each of the opposite sides of the guide to connect with grooves 42 and 44. A threaded hole 48 is provided at the bottom of the thread guide to receive a screw for use in attaching the guide to a machine, as on top cover 18. The guide is also provided at the bottom edge with a depending locating pin 50 for use in facilitating attachment of the pin to a machine surface.

Wear bar 30 is a resilient metal member having a modified U-shape suited to rendering the part receivable in the grooves 42, 44 and 46. As shown, the wear bar is formed with an elbow at 52 in arms 54 and 56 diverging toward the open end of the part. The wear bar is mounted onto the plastic guide 10 by pushing arms 54 and 56 up into groove 46 from the bottom of the guide until the bottom end 58 of the bar is seated in groove 46, and the arms 54 and 56 are aligned with grooves 42 and 44, whereupon the arms which are resiliently spread somewhat in the mounting process snap into grooves 42 and 44 to affix the portion of the wear bar on the guide.

Thread 20 extending through guide 10 by way of eyelet 12, wherein it is frictionally engaged by a depending fin 58, passes over and is supported by wear bar leg 54 extending above groove 42, and damage to the plastic material of the guide which would otherwise be caused by the thread forcibly cutting grooves into the plastic at the exit end of the eyelet is prevented. Because of the direction in which thread 20 enters eyelet 12 as shown in the drawings no support is required for the thread at this location to prevent damage to the plastic material of the guide. Thread 22 extending into and from opening 14 in the directions shown is supported at the thread exiting end of the opening by wear bar leg 54 extending above groove 42, and at the entering end by wear bar leg 56 extending above groove 54. Thread 22 is therefor prevented from damaging the plastic at each of the opposite ends of the opening.

It is to be understood that the present disclosure relates to a preferred embodiment of the invention which is for purposes of illustration only and is not to be construed as a limitation of the invention. Numerous alterations and modifications of the structure herein disclosed will suggest themselves to those skilled in the art, and all such alterations and modifications which do not depart from the spirit and scope of the invention are intended to be included within the scope of the appended claims.

We claim:

1. A plastic guide for sewing thread extending from a supply spool on a sewing machine, the guide including an opening for the thread to pass therethrough, and the guide being disposed on the machine to alter the direction of the thread path; and a metal wear bar affixed to the guide in a position to engage thread exiting from said opening and prevent the thread from cutting a groove in the plastic material of the guide at the exit end of the opening.

2. The combination of claim 1 wherein the wear bar is mounted in grooves in the guide.

3. The combination of claim 2 wherein the wear bar is resilient and snaps into grooves in the guide.

4. The combination of claim 1 wherein the wear bar is a resilient, U-shaped member which snaps into grooves in the guide.

5. The combination of claim 1 wherein the wear bar extends substantially parallel to an edge of the guide.

6. The combination of claim 1 wherein the plastic guide includes a second opening for thread from another spool to pass therethrough for use during twin needle sewing, the metal wear bar being disposed to engage thread exiting from each opening and prevent grooves from being cut into the plastic material at the exit end of each of the openings.

7. The combination of claim 6 wherein the wear bar is mounted in a groove extending substantially parallel to an edge of the guide.

8. The combination of claim 6 wherein the wear bar extends to opposite sides of the guide and is engageable with thread entering said second opening.

9. The combination of claim 6 wherein the wear bar is mounted in a groove extending from one side of the guide to the other, and further extending substantially parallel to an edge of the guide on each side of the guide.

* * * * *